US006485208B2

(12) United States Patent
Woodman et al.

(10) Patent No.: US 6,485,208 B2
(45) Date of Patent: Nov. 26, 2002

(54) PRINTING DEVICE

(75) Inventors: Michel Woodman, Huntingdon (GB); David Roger Tegerdine, Royston (GB); Clive Lawrence Ayling, Hauxton (GB); Geoffrey Stuart Howe, Newton Aycliffe (GB)

(73) Assignee: Esselte N.V., Sint-Niklaas (BE)

( * ) Notice: Subject to any disclaimer, the term of this patent is extended or adjusted under 35 U.S.C. 154(b) by 0 days.

(21) Appl. No.: 09/769,433

(22) Filed: Jan. 26, 2001

(65) Prior Publication Data

US 2001/0024590 A1 Sep. 27, 2001

(30) Foreign Application Priority Data

Jan. 27, 2000 (GB) ..... 0001913

(51) Int. Cl.[7] ..... B41J 11/28
(52) U.S. Cl. ..... 400/615.2; 400/74
(58) Field of Search ..... 400/615.2, 76, 400/70, 61, 74

(56) References Cited

U.S. PATENT DOCUMENTS

| | | | | |
|---|---|---|---|---|
| 5,559,924 A | | 9/1996 | Ogura et al. | 395/117 |
| 5,562,353 A | * | 10/1996 | Handa et al. | 400/61 |
| 5,595,450 A | * | 1/1997 | Beadman et al. | 400/615.2 |
| 5,813,779 A | * | 9/1998 | Palmer et al. | 400/485 |
| 5,860,752 A | * | 1/1999 | Watanabe et al. | 400/615.2 |
| 6,079,889 A | * | 6/2000 | Beadman et al. | 400/61 |
| 6,129,467 A | * | 10/2000 | Toyosawa et al. | 400/61 |
| 6,226,094 B1 | * | 5/2001 | Watanabe et al. | 358/1.11 |
| 6,270,269 B1 | * | 8/2001 | Watanabe et al. | 400/615.2 |
| 6,276,851 B1 | * | 8/2001 | Kurashina | 400/61 |

FOREIGN PATENT DOCUMENTS

| | | | |
|---|---|---|---|
| EP | 0 267 890 | 11/1987 | B41J/25/30 |
| EP | 0 322 918 A2 | 12/1988 | B41J/32/00 |
| EP | 0 322 919 A2 | 12/1988 | B41J/25/30 |
| EP | 506 460 | 9/1992 | |
| EP | 0 578 372 A2 | 1/1994 | B26D/9/00 |
| EP | 0 628 419 A2 | 12/1994 | B41J/21/08 |
| EP | 0 634 274 A2 | 1/1995 | B41J/3/407 |
| EP | 0 658 853 A2 | 6/1995 | G96F/17/21 |
| EP | 0 783 156 A2 | 7/1997 | G06F/17/21 |
| JP | 06008529 | 6/1992 | |
| JP | 07114550 | 10/1993 | |
| JP | 07137377 | 11/1993 | |
| WO | WO 92/09438 | 6/1992 | B41J/2/485 |

* cited by examiner

*Primary Examiner*—Andrew H. Hirshfeld
*Assistant Examiner*—Charles H. Nolan, Jr.
(74) *Attorney, Agent, or Firm*—Pennie & Edmonds LLP

(57) ABSTRACT

A printing device for printing labels that includes a display; a user input means for inputting an image to be printed by the printing device and for selecting a required label length; and a control means operable to determine the length of the image input via the user input means, and if 10 the length of the image input is greater than the required label length, the control means is arranged to cause the display to display an error message indicating the difference between the length of the image and the required label length, which may be the minimum length of the inputted image, the difference between a preselected length and the minimum length of the inputted image, or both.

31 Claims, 6 Drawing Sheets

PRINTING DEVICE

FIELD OF THE INVENTION

The present invention relates to a printing device and in particular but not exclusively to a tape printing device for printing an image on a tape.

BACKGROUND OF THE INVENTION

Known tape printing apparatus of the type with which the present invention is concerned are disclosed in EP-A-322918 and EP-A-322919 (Brother Kogyo Kabushiki Kaisha) and EP-A-267890 (Varitronic). The printers each include a printing device having a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A322919, the tape holding case houses an ink ribbon, a transparent image receiving tape and a double sided adhesive tape which is secured at one of its adhesive coated sides to the image tape after printing and which has a backing layer peelable from its other adhesive coated side. With both these apparatus, the image transfer medium (ink ribbon) and the image receiving tape (substrate) are in the same cassette.

It has also been proposed by the present applicants in, for example, EP-A-578372 to house the ink ribbon and the substrate tape in separate cassettes.

In all of these cases, the image receiving tape passes in overlap with the ink ribbon to a print zone consisting of a fixed print head and a platen against which the print head can be pressed to cause an image to transfer from the ink ribbon to the image receiving tape. There are many ways of doing this, including dry lettering or dry film impression, but the most usual way currently is by thermal printing where the print head is heated and the heat causes ink from the ink ribbon to be transferred to the image receiving tape.

It is known to provide a tape printing device which allows the user to select the character size with which it is desired to print and the length of label required. This can result in a problem if the selected character size results in the label which would be printed being longer than the length of label selected by the user. This problem is addressed in EP-A-0628419, in which, if this problem occurs, an error message is displayed which indicates that printing is not possible. However it is not particularly clear to the user as to the reason for the failure of the printing attempt.

It is an aim of embodiments of the present invention to address this problem. It may be desirable to provide options for the user to deal with the problem. It may be further desirable to allow the user to monitor the length of characters compared to the selected label length during the process of creating a label.

SUMMARY OF THE INVENTION

According to a first aspect of the present invention there is provided a printing device for printing labels comprising: a display; user input means for inputting an image to be printed by the printing device and for selecting a required label length; and control means operable to determine the length of the image input via the user input means, and if the length of the image input is greater than the required label length, the control means is arranged to cause the display to display an error message indicating the difference between the length of the image and the required label length.

According to a second aspect of the present invention, there is provided a printing device for printing labels comprising: a display; user input means for inputting an image to be printed by the printing device and for selecting a required label length; and control means operable to determine the length of the image input via the user input means, and if the length of the image input is greater than the required label length, the control means is arranged to cause the display to display an error message indicating the length of the input image.

According to a third aspect of the present invention, there is provided a printing device for printing labels of a required length, comprising: a display; user input means for inputting an image to be printed by the printing device; and control means operable to determine the length of the image input via the user input means, and if the length of the image input is greater than the required label length, the control means is arranged to cause the display to display an error message indicating the difference between the length of the image and the required label length.

According to a fourth aspect of the present invention, there is provided a method of printing labels using a printing device comprising the steps of : inputting an image to be printed by the printing device; displaying the image on a display; selecting a required label length; determining the length of the image input and if the length of the image input is greater than the required label length, causing the display to display an error message indicating the difference between the length of the image and the required label length.

According to a fifth aspect of the present invention, there is provided a method of printing labels using a printing device, comprising the steps of: inputting an image to be printed by the printing device; displaying the image on a display; selecting a required label length; determining the length of the image input and if the length of the image input is greater than the required label length, causing the display to display an error message indicating the length of the input image.

According to a sixth aspect of the present invention, there is provided a method of printing labels of a required length using a printing device, comprising the steps of: determining the required length; inputting an image to be printed by the printing device; displaying the image on a display; determining the length of the image input and if the length of the image input is greater than the required label length, causing the display to display an error message indicating the difference between the length of the image and the required label length.

For a better understanding of the present invention and as to how the same may be carried into effect, reference will now be made by way of example to the accompanying drawings.

DETAILED DESCRIPTION OF PREFERRED EMBODIMENTS

Figure 1:
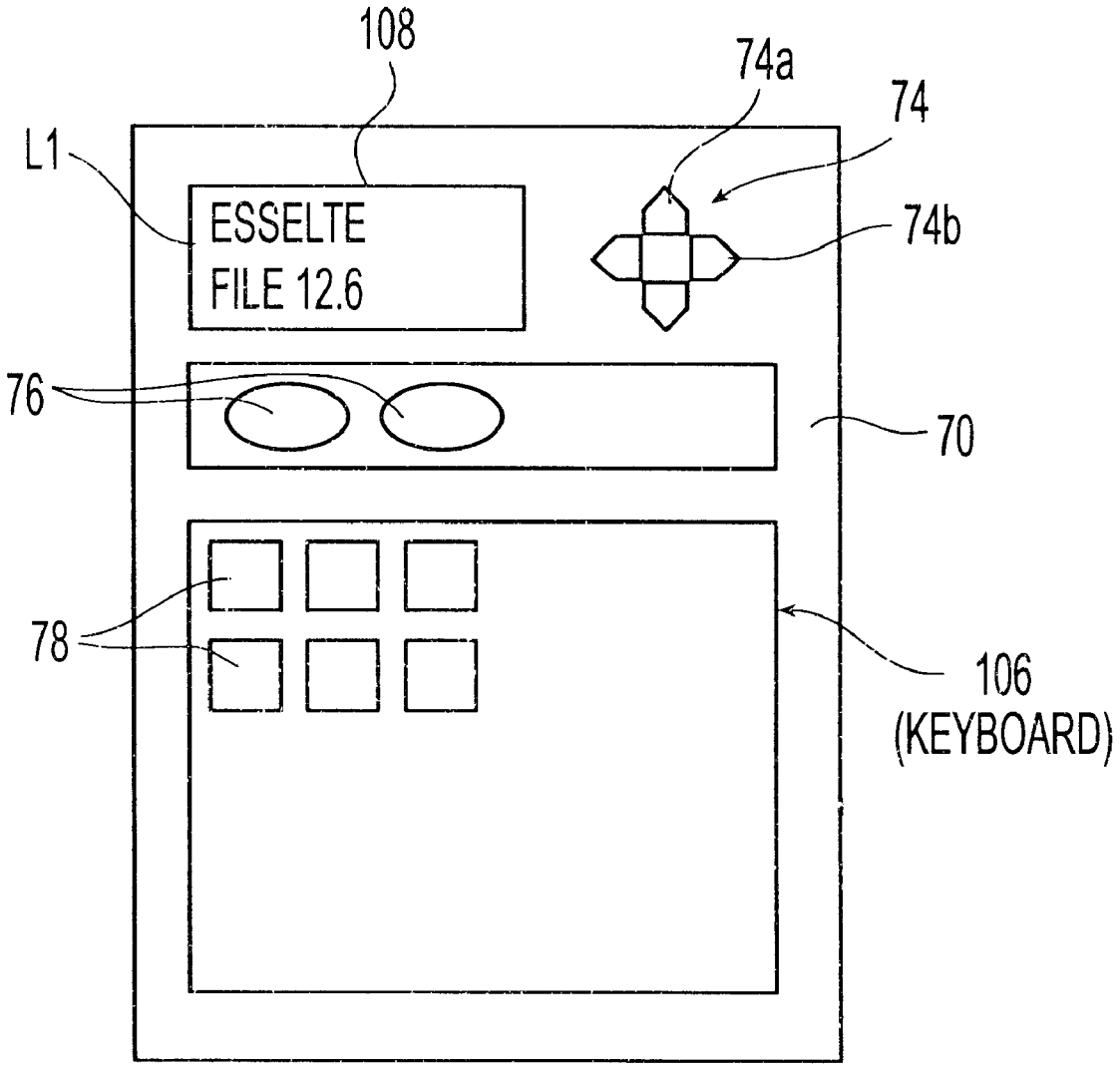
FIG. 1 is a schematic diagram of the front part of the casing of a printing device.

FIG. 1 illustrates the front of a tape printing device. Reference numeral 70 denotes the casework of the printer. The front of the printer carries a liquid crystal display (LCD) 108 and a keyboard 106 having a plurality of cursor control keys 74, a plurality of function keys 76, only two of which are illustrated in FIG. 1, and a plurality of character selecting keys 78, only six of which are illustrated in FIG. 1. The keyboard 106 is used for inputting characters to the tape printing device. This could be achieved with other input means, for example a touch pad or a touch screen. The function keys include a return key, a save key, a recall key, a delete key, an edit key and a print key. As is known, combinations of keys can be used in place of individual keys for each function. The display can display two lines of text. Other embodiments may be able to display more or less than two lines of text. The display is illustrated displaying the two line label (Ll) ESSELTE (first line) FILE 126 (second line). As is known, the character selecting keys 78 allow characters to be selected by a user to formulate labels to be printed. The term "characters" in the following refers to numerals, symbols, icons, background patterns, barcodes and the like, as well as text characters, which together may make up an image to be printed on a label. The function keys 76 allow different functions to be implemented, and in effect control the operational modes of the printer. The use of some of these function keys 76 will be described below.

The printer operates with a supply of tape on which images are printed. In some embodiments lengths of the tape are cut off after a label has been printed. The tape is housed in a cassette which is held in a cassette bay on the underside of the printer.

Typically, this tape printing device 1 is a hand held or small desk top device which is powered by batteries at least part of the time.

Figure 2:
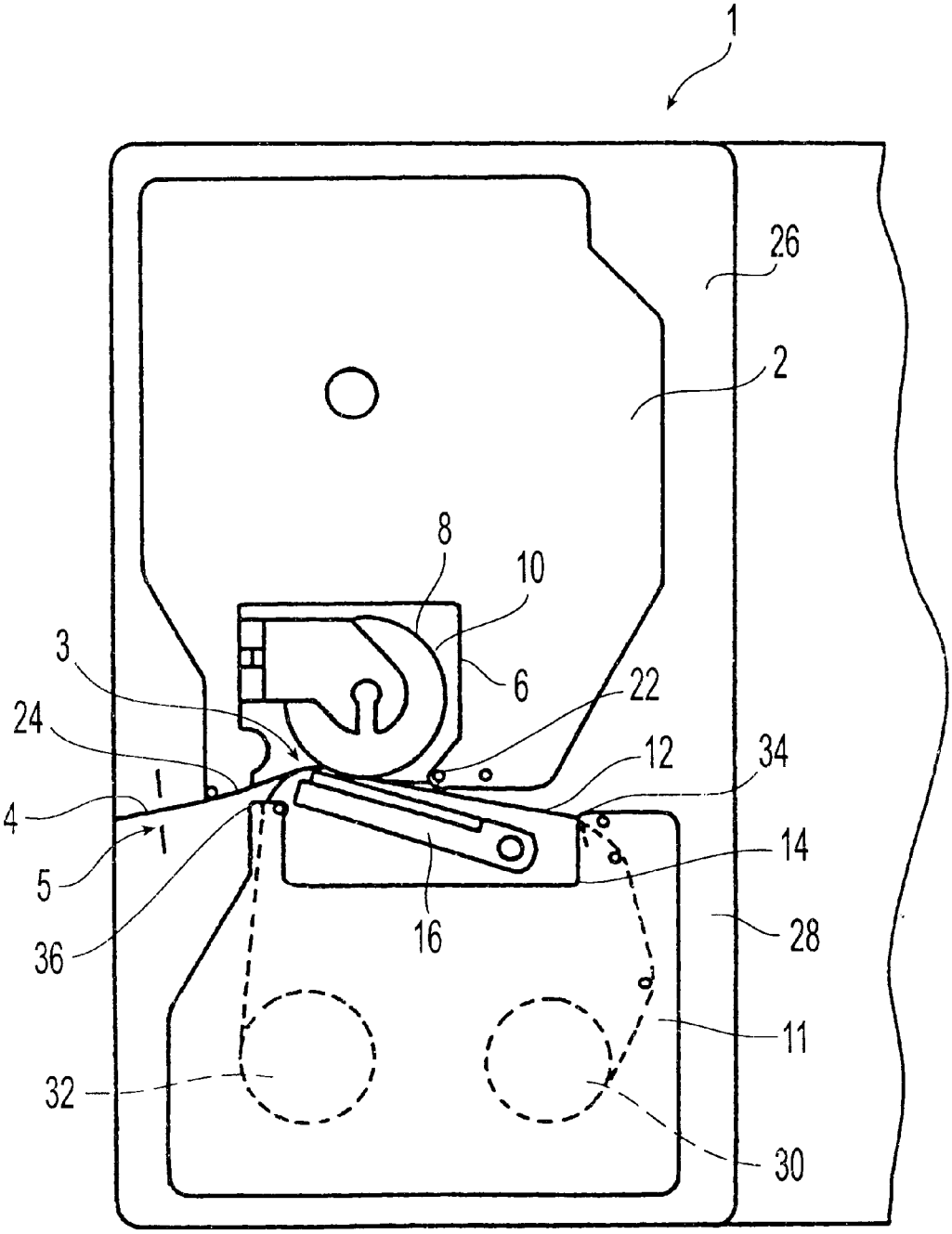
FIG. 2 is a plan view of a first tape printing device embodying the present invention using a two cassette system.

FIG. 2 shows in plan view, with the outer casework depicted in FIG. 1 removed, the first tape printing device embodying the present invention which has two cassettes arranged therein. The upper cassette 2 is located in a first cassette receiving portion 26 and contains a supply of image receiving tape 4 which passes through a print zone 3 of the tape printing device 1 to an outlet 5 of the tape printing device 1. The image receiving tape 4 comprises an upper layer for receiving a printed image on one of its surfaces and has its other surface coated with an adhesive layer to which is secured a releasable backing layer. The upper cassette 2 has a recess for accommodating a platen 8 of the tape printing device 1, and guide portions 22 and 24 for guiding the tape through the print zone 3. The platen 8 is mounted for rotation within a cage molding 10.

Alternatively, the platen could be mounted for rotation on a pin.

The lower cassette 11 is located in a second cassette receiving portion 28 and contains a thermal transfer ribbon 12 which extends from a supply spool 30 to a take up spool 32 within the cassette 11. The thermal transfer ribbon 12 extends through the print zone 3 in overlap with the image receiving tape 4. The cassette 11 has a recess 14 for receiving a print head 16 of the tape printing device 1 and guide portions 34 and 36 for guiding the thermal transfer ribbon 12 through the print zone 3. The print head 16 is movable between an operative position shown in FIG. 1, in which it is in contact with the platen 8 and holds the thermal transfer ribbon 12 and the image receiving tape 4 in overlap between the print head 16 and the platen 8 and in an inoperative position in which it is moved away from the platen 8 to release the thermal transfer ribbon 12 and image receiving tape 4. In the operative position, the platen 8 is rotated to cause the image receiving tape 12 to be driven past the print head 16 and the print head 16 is controlled to print an image on the image receiving tape 4 by thermal transfer of ink from the ribbon 12.

Figure 4:
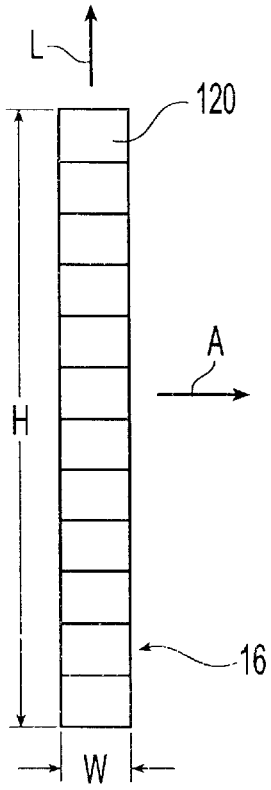
FIG. 4 shows a schematic view of the print head of FIG. 2 or FIG. 3.

The thermal print head 16 is shown in FIG. 4 and comprises a column of printing elements 120. The print head 16 has a height H which is large enough to print on the widest width of tape. The print head has a width which is equal to the width of one printing element. Each of the printing elements is activatable separately and is activated in accordance with the desired image to be printed.

The tape printing device 1 has a lid (which is not shown) but which is hinged along the rear of the cassette receiving portions 26 and 28 and which covers both cassettes when in place.

A dc motor 7 (see FIG. 5) continuously drives the platen 8. The platen is arranged to drive the image receiving tape 4 through the print zone 3 by the actuation of its own rotation.

The image is printed by the print head 16 on the image receiving tape on a column by column basis with the columns being adjacent one another in the direction of movement of the tape 4.

Figure 3:
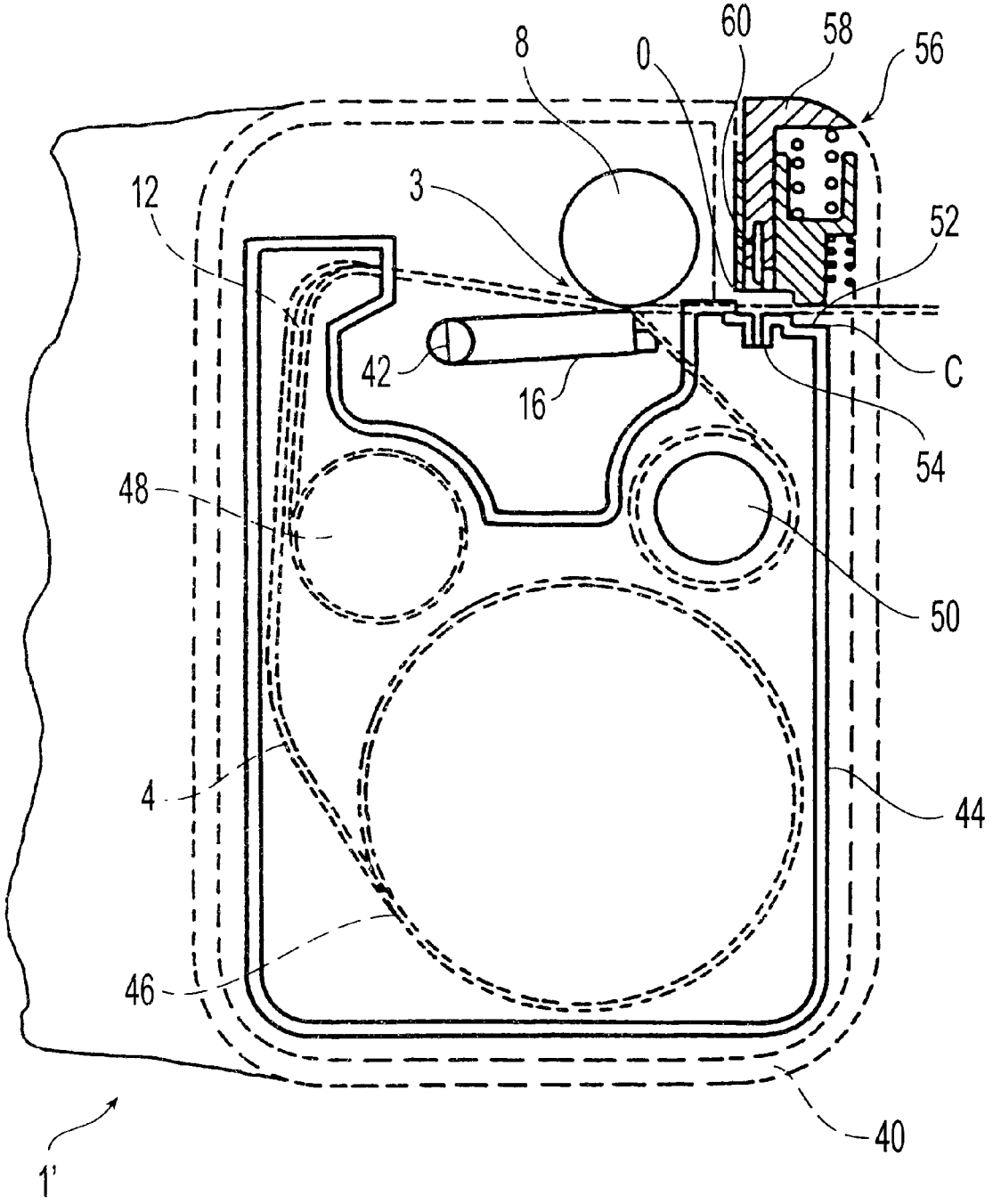
FIG. 3 is a plan view of a second tape printing device embodying the present invention, using a one cassette system.

FIG. 3 illustrates in plan view a cassette bay of a second printing device 1' embodying the present invention which uses a one cassette system. It has its outer casing as depicted in FIG. 1 removed. Like reference numerals are used for those parts which are also shown in FIG. 2. The cassette bay is shown by the dotted line 40. The cassette bay 40 includes a thermal print head 16 and a platen 8 which cooperate to define a print zone 3. The thermal print head 16 is the same as that discussed in relation to FIG. 2 and shown in FIG. 4.

The print head 16 is pivotable about a pivot point so that it can be brought into contact with the platen 8 for printing and moved away from the platen 8 to enable the cassette to be removed and replaced as in the first embodiment. A cassette inserted into the cassette bay 40 is denoted generally by reference numeral 44. The cassette 44 holds a supply spool 46 of image receiving tape 4. The image receiving tape 4 is guided by a guide mechanism (which is not shown) through the cassette 44, out of the cassette 44 through an outlet 0 past the print zone 3 to a cutting location C. The same cassette 44 also has an ink ribbon supply spool 48 and an ink ribbon take up spool 50. The ink ribbon 12 is guided from the ink ribbon supply spool 48 through the print zone 3 and taken up on the ink ribbon take up spool 50. As with the first embodiment, the image receiving tape 4 passes in overlap with the ink ribbon 12 through the print zone 3 with its image receiving layer in contact with the ink ribbon 12. The platen of this second embodiment is also driven by a motor 7. The motor rotates to drive the image receiving tape through the print zone 3 continuously during printing. In either of the embodiments, it is possible that the tape be driven in a step wise manner by a stepper motor.

An image is printed on the tape fed out from the print zone to the cutting location C which is provided at a location in a portion of the wall of the cassette 44 which is close to the print zone 3. The portion of the wall on the cassette 44 where the cutting location C is defined is denoted by reference 52. A slot 54 is defined in the wall portion 52 and the image receiving tape 4 is fed past the print zone 3 to the cutting location C where it is supported by facing wall portions on either side of the slot 54.

The second tape printing device 1' includes a cutting mechanism 56 including a cutter support member 58 which carries a blade 60. The blade 60 cuts the image receiving tape 4 and then enters the slot 54. It should be appreciated that the first embodiment will usually also include a cutting mechanism.

Figure 5:
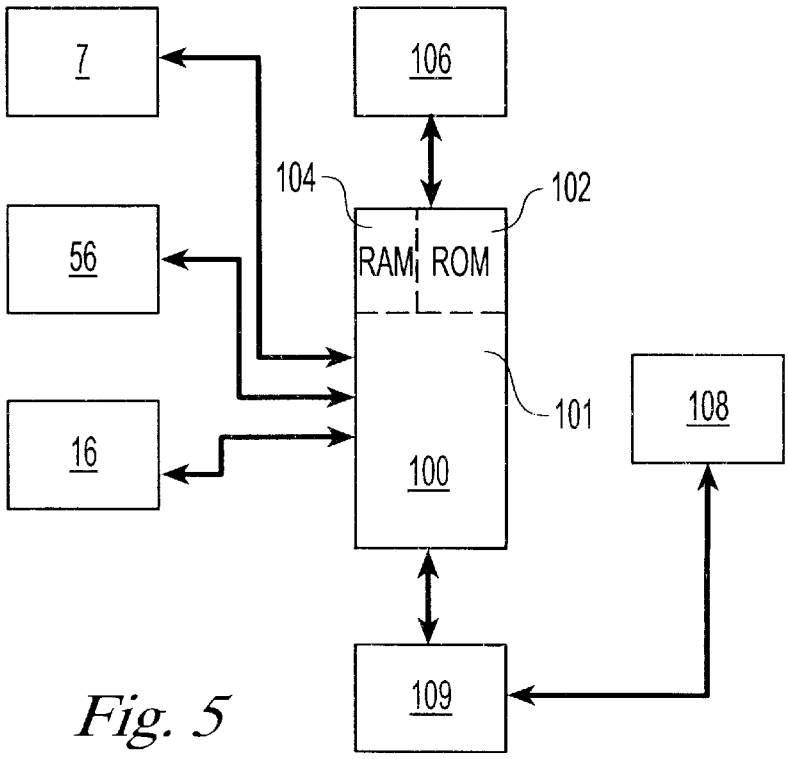
FIG. 5 is a diagrammatic sketch showing the control circuitry for the printing device of FIG. 2 or of FIG. 3.

Basic circuitry for controlling the tape printing device 1 of FIG. 2 or the tape printing device 1' of FIG. 3 is shown in FIG. 5. There is a microprocessor chip 100 having a read only memory (ROM) 102, a microprocessor 101 and random access memory capacity indicated diagrammatically by RAN 104. The microprocessor chip 100 is connected to receive label data input to it from a data input device such as a keyboard 106. The microprocessor chip 100 outputs data to drive a display 108 via a display driver chip 109 to display a label to be printed (or a part thereof) and/or a message for the user. The display driver alternatively may form part of the microprocessor chip. Additionally, the microprocessor chip 100 also outputs data to drive the print head 16 50 that the label data is printed onto the image receiving tape to form a label. Finally, the microprocessor chip 100 also controls the motor 7 for driving the platen. The microprocessor chip 100 may also control the cutting mechanism 56 of FIG. 3 or a cutting mechanism of FIG. 2 to allow a length of tape to be cut off. In alternative embodiments at least part of the cutting mechanism may be manually operated.

The type of print head 16 with which embodiments of the present invention are concerned is shown in FIG. 4 and generally comprises a plurality of printing elements 120 which are selectively heated to allow thermal printing to take place. The thermal printing can be directly onto thermally sensitive image receiving tape 4 or can be by means of an ink ribbon 12 such as shown in the embodiments of FIGS. 2 and 3. As discussed in relation to these embodiments, the ink ribbon 12 is arranged between the print head 16 and the image receiving tape 4. The application of heat to the ink ribbon 12 by selected printing elements 120 of the print head 16 causes an image to be transferred to the image receiving tape. Each printing element 120 is generally square to print a square pixel on the image receiving tape. However, the printing elements may be rectangular or the like.

Each printing element 120 is a resistive element which, when current has passed therethrough is heated up. The printing elements 120 are selectively heated so as to allow an image to be printed on the image receiving tape 4 as it passes the print head 16. The image printed on the image receiving tape 4 is defined by a plurality of contiguous or adjacent columns of pixels. Thus the image printed on the image receiving tape 4 depends on which printing elements 120 are activated or heated and when. The image receiving tape 4 moves generally in the direction of arrow A, that is in the length wise direction of the image receiving tape 4 and perpendicular to the longitudinal axis L of the print head 16.

The schematic representation of the print head shown in FIG. 4 has twelve printing elements. In practice, the print head will have many more printing elements, for example 128. The print head 16 will generally have a height H slightly less than the width of the image receiving tape 4 to be used with the tape printing device 2. Where more than one width of tape is to be used with the tape printing device 2, the print head 16 will generally have a height H corresponding to the width of the largest image receiving tape 4 to be used with the tape printing device 12. Generally, the width W of the print head is equal to the width w of one printing element 120 to thereby form a column shaped print head 16.

Figure 6:
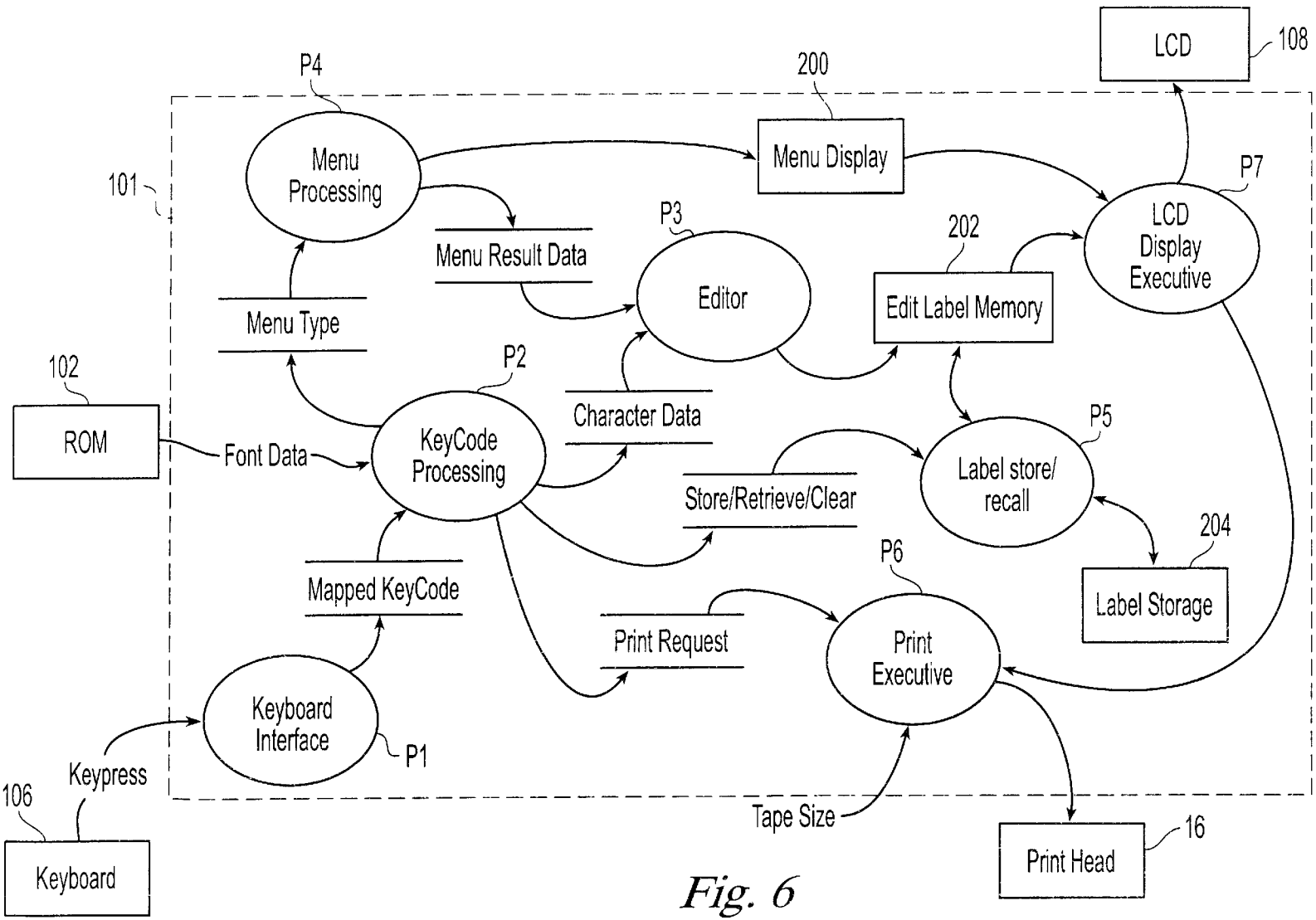
FIG. 6 is a diagram illustrating some of the control components of the printing device in greater detail.

FIG. 6 illustrates some of the control components of the printer as shown in FIG. 5. The dashed line 101 represents the print controller, and in this embodiment it is the microprocessor 101 which is depicted in FIG. 5, although it need not necessarily be a microprocessor. The circles within the controller 101 denote program components which are run within it to implement different control functions as described in the following. The controller 101 includes random access memory (RAM) 104. The RAM of FIG. 5 is included in the controller of FIG. 6. In practice, the RAM may be implemented on the same chip as the processor, or be provided as a separate chip connected to the controller 101. The blocks with double lines at the top and bottom labelled 200, 202, 204 represent portions of RAN 104. Block 200 is a menu display portion, block 202 is an edit label memory portion and block 204 is a label storage portion. In addition, the controller 101 contains or is associated with read only memory (ROM) 102 which holds font data for the characters. The controller 101 controls operations of the display 108 and supplies print data to the print head 16. It receives inputs from the ROM 102 and the keyboard 106.

The controller 101 runs a number of different programs to control operations of the printer. A keyboard interface program P1 receives key presses from the keyboard 106 and provides mapped key code data to a key code processing program P2. The key code processing program P2 has a number of different functions. It supplies menu-type data to a menu processing program P4 depending on the menu which is selected by the function keys 76 of the printer. The key code processing program P2 supplies character data to an editor program P3 depending on the characters selected by the character selection keys 78 of the keyboard 106. The key code processing program P2 supplies label store/recall functions to a label store/recall program PS. Finally, the key code processing program P2 supplies print request data to a print executive program P6.

The menu processing program P4 supplies menu result data to the editor program P3 and also supplies menu display data for storage in the RAM portion 200. The editor program P3 acts on the menu result data and character data to formulate and edit a label which is stored in a working portion of the RAM 104, the edit label memory portion, labelled 202 in FIG. 6. This working portion 202 of the RAM 104 holds data defining the current label which is being formulated and/or edited.

The label store/recall program P5 is operable responsive to store/recall functions supplied from the key code processing program P2 to transfer label data between the working portion 202 of the RAM 104 and a storage portion (label store/recall portion) 204 of the RAM 104.

The print executive program P6 receives tape size information (discussed later) in conjunction with print requests from the keyboard and controls operation of the print head 16 based on the label data which is held in the working portion 202 of the RAM.

Finally, the controller 101 runs an LCD display executive program P7 which manages data to be displayed on the display 108 based on the contents of the menu display portion 200 of the RAM and the working portion 202 of the RAM.

The printer can accommodate tapes having a plurality of different widths, in particular 6 mm, 9 mm, 12 mm, 19 mm and 24 mm. A switch allows a selection to be made between three settings, 6 mm; 9/12 mm; 19/24 mm. The manner in which this switch cooperates with the printer is described in our earlier European Patent EP634274 and therefore is not discussed further herein. In any event it will be appreciated that any manner of conveying tape size information to the print executive program P6 may be used.

Figure 7:
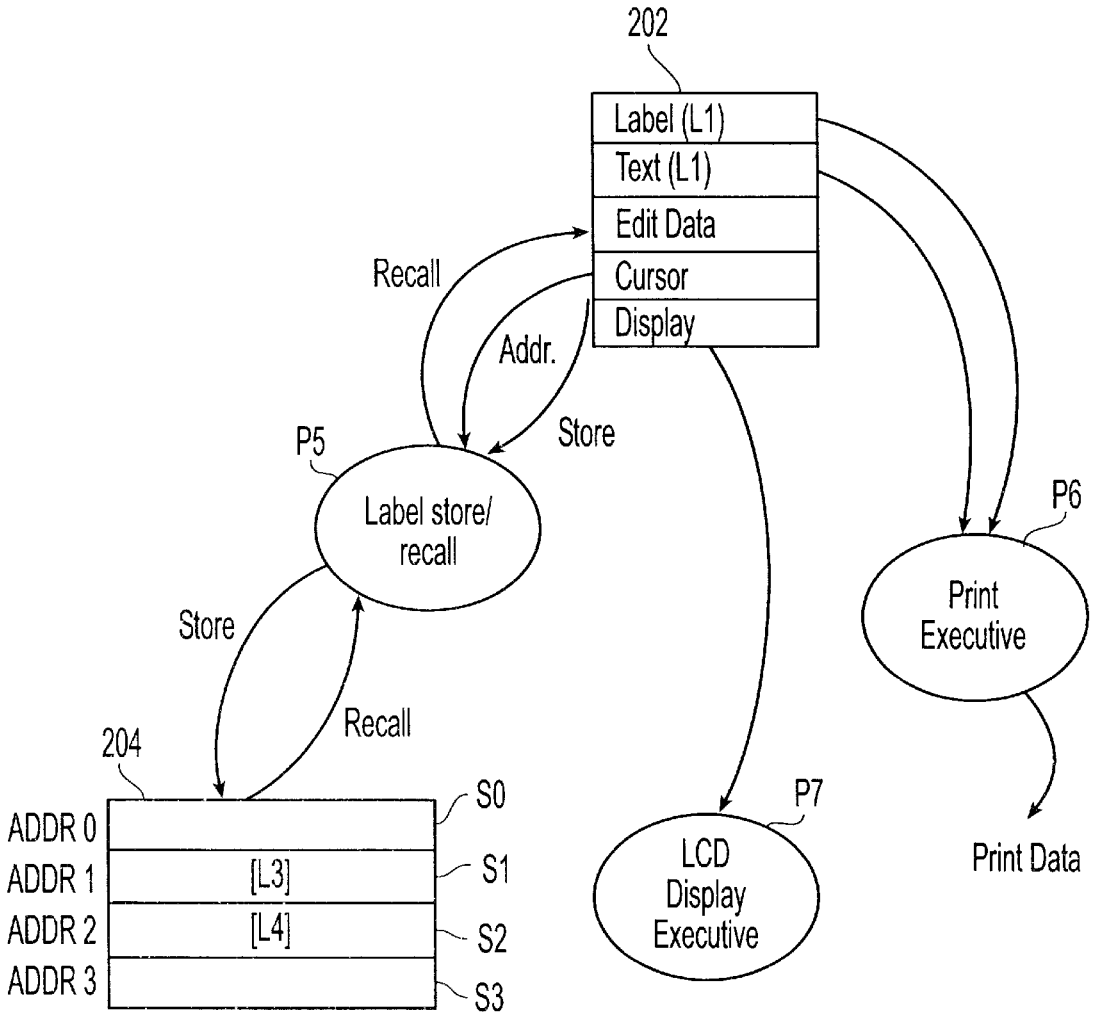
FIG. 7 shows some of the elements of FIG. 6 in more detail.

Label data is held in the working portion 202 of the RAM in different data structures as shown in FIG. 7. In particular, a text data structure label type (marked text in FIG. 7) holds text data (CharCode) regarding the characters and symbols, etc, which have been selected for printing. The text data includes new page and new line information. An attribute data structure page setting type (marked label in FIG. 7) holds attributes with which the characters are to be printed, and effectively defines the format of the label. In addition, the working portion 202 of the RAM contains edit data including the position of a cursor as a file cursor type and display control information. At any time, label data and edit data for one label is held in the working portion 202 of the RAM.

The print executive program P6 generates print data for the print head as a sequence of columns of dot data based on the text data and attribute data. The edit data is not used for printing. The print executive P6 does not formulate a complete dot pattern image of the label to be printed in RAM prior to printing. Instead, column data is prepared "on the fly". Thus, the print executive program P6 extracts text data from the text data structure, and attribute data from the attribute data structure, and manipulates this data to generate successive print columns. The print head contains a buffer which holds one column of dot data, while the print head itself prints a column of dot data at a time. Thus, while the print head is printing one column, the next column can be placed in the buffer ready for printing. This technique is described in our earlier European Patent EP5132 90.

When a user is using the tape printing device to produce a label, the first selection to be made is the selection of tape width, as described above. In this embodiment, the example of the creation of tape Ll will be used. Once the selection of tape width has been made, there are also a number of possible character sizes which may be selected. The display shows the current character size. One of the function keys 76 can be pressed to select a size menu. The cursor keys 74 can then be used to scroll down the menu to select the required character size. Once this choice has been made, the user can create label Ll by typing in the characters using the character keys 78. Another of the function keys 76, the return key, is used after the third "E" of "ESSELTE" to allow the two lines of text to be created. Keyboard interface program P1 receives the keyboard presses from keyboard 106 and provides mapped key code data to the key code processing program P2. The key code processing program P2 supplies the character data to the editor program P3. The character size selection information is supplied from the menu processing program P4 to the editor program P3. The editor program P3 uses the character data and character size information to formulate the label. This formulated text data, including the return key information, is put into the text data structure label type in the working portion 202 of the RAM 104. The label is then displayed on display 108 by use of the executive program P7 which acts on the data in working portion 202.

The next decision to be made by the user is the length of label with which it is desired to print. In default mode (automatic length mode), there is no need to calculate this length, because it is dependent on the number of characters in the longest line of text of the label (in label Ll this would be "FILE 126") and the selected character size. This means that the label will be printed with the selected characters and character size using default character spacing, thus it is not a parameter which is actually controllable by the user.

Alternatively, the user can select a fixed length with which the label is to be printed, in other words "fixed length mode", can be selected. Both embodiments of the tape printer as shown in FIGS. 2 and 3 are provided with a function key called "LTH". This is another of the function keys 76 illustrated in FIG. 1. This key is pressed in order to enter fixed length mode. When it is pressed it causes the display 108 to display the previous length of label selected by the user the last time that fixed length mode was used. The user then has two options. Either the "delete" function key (another of function keys 76) can be pressed to exit fixed length mode, in which case the tape printer will revert to automatic length mode as described in the previous paragraph, or the user can choose to remaiii in fixed length mode.

If the user chooses to remain in fixed length mode, the user can then use the cursor keys 74 to alter the required length. For example, the up and down cursor keys 74*a* can be used to alter the label length in 1 mm steps and the left and right cursor keys 74*b* can be used to alter the label length in 10 mm steps. It would of course be possible to set the cursor keys up to allow other increments, for example it would be possible to display the chosen fixed length in inches and allow increments of fixed length in inches. In this embodiment the minimum fixed label length is 40 mm and the maximum label length is 4 meters, but these limits could be different in other embodiments. It would alternatively be possible to select the required length using numeral keys or a menu which allowed selection of one of a plurality of possible lengths. Once the user has selected the required label length, the return function key is pressed, which has the effect of setting this length for all subsequently printed labels. In one embodiment, the display shows the set length. If, on the other hand, the user alters the fixed length but then decides to revert to automatic length mode, this can be done by pressing the "LTH" key again. A second press of the "LTH" key will allow the user to re-enter the menu.

At any time it is possible to revert to automatic length mode by pressing a further function key 76, the shift key, followed by the delete key.

After setting the required length, the user inputs the image to be printed. Once the image has been input, the user presses the "print" function key to print the label. At this stage the microprocessor 101 calculates the total length of the text, based on the characters and character size in the working portion 202 of the RAM 104, together with font information from the ROM 102 which indicates the width of each character and default spacing between each character for the selected character size. Thus the total length of the text will be the total length of all the characters and the spaces between them in the longest line of text, where there are two or more lines of text. This calculated total length is compared to the selected fixed length of label selected by the user. If this length is equal to or less than the fixed length of label selected by the user, the label will be printed. If this length is less than the fixed length of label selected by the user, the difference in length will be a blank margin. It is possible to use a further function key to justify the text, for example to center it on the label, in which case the difference in length would appear as two equally sized blank margins either side of the text. In some embodiments of the invention, this will be done automatically.

Figure 8:
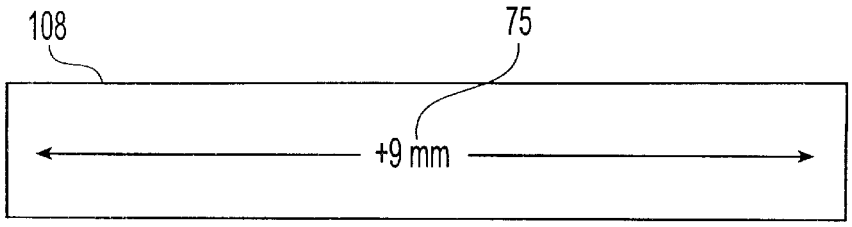
FIG. 8 shows an error message displayed in an embodiment of the invention.

If the total length of the text is greater than the fixed length of label selected by the user, the microprocessor 101 will calculate how much greater it is, using the difference between the total length of text and the fixed length of label selected. This difference (called "how much longer") is displayed on the display 108 as an error message in units of mm (other units could be used, for example if the printer was set up to allow increments of fixed length in inches, the error message could be displayed in inches). An example of such a display is shown as reference numeral 75 in FIG. 8, in which the difference is 9 mm. In this embodiment, as shown in FIG. 8, the error message is displayed across the entire screen. In one embodiment it is "flashed" at intervals of approximately two seconds, between which, the display reverts to the label characters. It would be possible to vary the display, for example by only displaying the error message in one part of the screen or varying or not using the "flash". The user then has two options.

The first option is to press the "LTH" function key to display the selected fixed length of label, and then use the cursor keys 74 to increase the fixed length by "how much longer" or more. When the return function key is pressed, followed by the print function key, the label will print with the new selected fixed length.

The second option is to press the shift key, followed by the delete key. This allows reversion to automatic length mode, hence the label can be printed at the total length of the text, which is the length which the characters and selected character size requires, as explained above. The same effect would be achieved by pressing the "LTH" key followed by the delete key.

A further option would of course to be to delete some characters from the label or to change the font size.

The error message can be displayed at any suitable location on the display. In some embodiments of the invention, the error message alone can be displayed or it may be displayed with at least part of the input image.

In an alternative embodiment, instead of displaying the figure representing "how much longer", the microprocessor displays as an error message the total length of the text in mm (other units could be used). This tells the user the potential length of the label, that is what the length of the label would be if it were printed. This is the length the label would be if the user were in automatic length mode. The user then has two options. The first option is to accept this automatic length and then print the label. This means that the user is reverting to automatic length mode for this particular label, but fixed length mode is still selected for subsequent labels. It would be possible to revert to automatic length mode for subsequent labels by pressing the shift key followed by the delete key. The second option is to press the "LTH" function key to display the selected length, and then used the cursor keys 74 to increase the fixed length to the total length as displayed in the error message, or greater. When the return function key is pressed, followed by the print function key, the label will print with the new selected length.

In a further embodiment, instead of calculating the total length of the text when the print key is pressed, the microprocessor 101 performs a length calculation each time a character is pressed. This means that when the first character key is pressed, it will retrieve the width information for that character in the selected character size from the ROM 102 and store that as a current total length. When the next character key is pressed the microprocessor 101 will retrieve from the ROM 102 the width of the second character and associated spa-information and add these to the first character width to produce a new value for current total length. In some embodiments of the invention, the character information will include spacing information, and in other embodiments of the invention information relating to the spacing between separate characters may be separately retrieved. This process is repeated each time a new character key is pressed. After each such calculation, the current total length is compared to the fixed length selected by the user. If at any time, the current total length exceeds the fixed length selected by the user, one of the error messages will be displayed (either "how much longer" or total length of text). In this way, the user can then exercise the options to deal with the problem during the process of creating a label, instead of only being warned when the entire label has been created. The first and second options described above for each of the two types of error message are available.

In certain instances, it is possible that performing the above-described length calculation each time a character key is pressed would slow down operation of the tape printer. This might result in a time lag between the user pressing a key and the display responding, which would be undesirable. Therefore, in yet a further embodiment, each time a character key is pressed, a flag is set. When the user pauses during typing of the label, as would be normal for example for a "thinking pause", the microprocessor 101 retrieves the character width and spacing information from the ROM 102 for all the flagged characters and uses it to calculate the current total length. This current total length is then compared to the fixed length selected by the user. If this current total length is less than the fixed length selected by the user, no error message is displayed. At each subsequent pause, the extra character width and spacing is retrieved from ROM 102 and added to the previous current total length. If upon any of these calculations, the current total length is found to exceed the fixed length, one of the above-described error messages is displayed. Thus the user can deal with the problem during creation of the label, but the speed of operation of the tape printer is not impaired.

The printing device has a further function key which allows the text to be printed vertically on the label. The above embodiments would work in a similar manner in this situation except that instead of using character width data from ROM 102, character height data would be retrieved.

In yet a further embodiment, the tape printer is provided with a sensor which enables it to determine the required fixed length itself, from the image receiving tape 4 or from one of the cassettes 2, 44. One example in which this embodiment would be useful is the case when the image receiving tape comprises die-cut labels. Thus the tape printer would detect a fixed length which would correspond to the length of one label. It could do this by various means, for example by detecting two edges of a label, or by detecting a particular hole or protrusion provided on the cassette body, which indicated that the image-receiving tape comprised labels of a particular length. In this embodiment, the same error messages as in the above-described embodiments are available, but it is not possible for the user to alter the set fixed length nor to revert to automatic length mode. Instead, the user has the option of removing some of the characters from the label or choosing a smaller font size, so that the characters fit within the fixed label length.

It will be appreciated, that in the above embodiments some specific key sequences have been described. It would of course be possible to perform the same operations using a different number of key sequences or using different keys or using means other than keys, depending on the particular keyboard or other input means provided.

We claim:

1. A printing device for printing labels, the printing device comprising:

a display;

an input mechanism for inputting an image to be printed by the printing device and an input mechanism for selecting a label length;

a controller operable to determine the length of the image input via the input mechanism, and if the length of the image input is greater than the selected label length, the controller causes the display to display an error message which includes a value indicating the difference between the length of the input image and the selected label length; and a printer for printing the input image onto a print medium in order to produce a label.

2. The printing device of claim 1, wherein if the length of the image is larger than the required length the printing device is arranged to permit a user to cause the device to perform one or more of the following:

de-select the selected label length to allow the device to print a label of the required length;

modify the selected label length to be greater than or equal to the length of the image to be printed;

and modify the image.

3. The printing device of claim 1, wherein the controller is operable to determine the length of the image input via the input mechanism when the user attempts to print a label.

4. The printing device of claim 1, wherein the image is input in discrete portions, and wherein the controller is operable to determine the length of the image input via the input mechanism after each portion is inputted.

5. The printing device of claim 1, wherein the image is input in discrete portions, and wherein the controller is operable to determine the length of the image input via the input mechanism during pauses of a preselected interval as the image portions are inputted.

6. The printing device of claim 1, wherein the controller is operable to control the printer only to print the image if the selected label length is greater than the length of the image.

7. The printing device of claim 1, wherein the image comprises one or more of characters; numerals; symbols; background patterns; barcodes; and icons.

8. The printing device of claim 1, wherein the label has at least one margin, and the controller is arranged to include the at least one margin in determining the length of the image.

9. The printing device of claim 1, further comprising storage for storing image information, the controller determining the length of the input image using the stored image information.

10. The printing device of claim 9, wherein the information stored comprises image data defining each element selectable by the input mechanism including size information.

11. The printing device of claim 1 wherein the error message comprises the minimum length of the label.

12. The printing device of claim 1 wherein the error message comprises the difference between the minimum length of the label and the selected label length.

13. The printing device of claim 1, wherein the input mechanism is arranged to permit the size of at least one element of said image to be selected.

14. The printing device of claim 1, wherein the selected label length is selected from a menu.

15. The printing device of claim 1, wherein the selected label length is selected from a menu which includes preselected lengths, or where the selected label length is fixed permanently, or where the selected label length is selected by utilizing pre-cut print medium, or a combination thereof.

16. The printing device of claim 1, wherein the selected label length is selected by repeated actuation of one or more elements of said input mechanism.

17. The printing device of claim 1, wherein the selected label length is selected by inputting the value of the required length.

18. A printing device for printing labels comprising:

a display;

user input means for inputting an image to be printed by the printing device and for selecting a required label length; and control means operable to determine the length of the image input via the user input means, and if the length of the image input is greater than the required label length, the control means is arranged to cause the display to display an error message indicating the length of the input image.

19. A printing device for printing labels of a required length, comprising:

a display;

user input means for inputting an image to be printed by the printing device; and control means operable to determine the length of the image input via the user input means, and if the length of the image input is greater than the required label length, the control means is arranged to cause the display to display an error message indicating the difference between the length of the image and the required label length.

20. A method of printing labels using a printing device comprising the steps of:

inputting an image to be printed by the printing device;

displaying at least a portion of the image on a display;

selecting a required label length;

determining the length of the image input and, if the length of the image input is greater than the required label length, causing the display to display an error message indicating the difference between the length of the image and the required label length.

21. The method of claim 20 wherein the error message indicating the length of the input image that would be printed, allowing the user to easily determine the difference between the length of the image and the required label length.

22. A method of printing labels of a required length using a printing device, comprising the steps of:

determining the required length;

inputting an image to be printed by the printing device;

displaying the image on a display;

determining the length of the image input and, if the length of the image input is greater than the required label length, causing the display to display an error message indicating the difference between the length of the image and the required label length.

23. A printing device for printing labels, the printing device comprising:

a display;

an input mechanism for inputting an image to be printed by the printing device and an input mechanism for selecting a label length;

a controller operable to determine the length of the image input via the input mechanism, and if the length of the image input is greater than the selected label length, the controller causes the display to display an error message which includes a value indicating the difference between the length of the input image and the selected label length; and a printer for printing the input image onto a print medium in order to produce a label, wherein the image is input in discrete elements, and wherein each time an image element is input via the input mechanism a flag is set in the controller, and when there is a pause in inputting of image elements, the controller is adapted to determine the length of all the flagged image elements to determine the length of the portion of the image which has been input, and when the length of the image exceeds the selected length, the controller is adapted to make the error message be displayed.

24. The printing device of claim 1, wherein the image comprises one or more of characters, numerals, symbols, background patterns, barcodes, and icons, and wherein at least one of the characters, numerals, symbols, barcodes, or icons in the image has a displayed length different from that of at least one of the other characters, numerals, symbols, barcodes, or icons in the image.

25. The printing device of claim 19, wherein the image comprises one or more of characters, numerals, symbols, background patterns, barcodes, and icons, and wherein at least one of the characters, numerals, symbols, barcodes, or icons in the image has a displayed length different from that of at least one of the other characters, numerals, symbols, barcodes, or icons in the image.

26. The method of claim 20, wherein the image comprises one or more of characters, numerals, symbols, background patterns, barcodes, and icons, and wherein at least one of the characters, numerals, symbols, barcodes, or icons in the image has a displayed length different from that of at least one of the other characters, numerals, symbols, barcodes, or icons in the image.

27. The method of claim 22, wherein the image comprises one or more of characters, numerals, symbols, background patterns, barcodes, and icons, and wherein at least one of the characters, numerals, symbols, barcodes, or icons in the image has a displayed length different from that of at least one of the other characters, numerals, symbols, barcodes, or icons in the image.

28. The printing device of claim 1, wherein the image comprises one or more of characters, numerals, symbols, background patterns, barcodes, and icons, and wherein at least one of the characters, numerals, symbols, barcodes, or icons in the image has a printed length different from that of at least one of the other characters, numerals, symbols, barcodes, or icons in the image.

29. The printing device of claim 19, wherein the image comprises one or more of characters, numerals, symbols, background patterns, barcodes, and icons, and wherein at least one of the characters, numerals, symbols, barcodes, or icons in the image has a printed length different from that of at least one of the other characters, numerals, symbols, barcodes, or icons in the image.

30. The method of claim 20, wherein the image comprises one or more of characters, numerals, symbols, background patterns, barcodes, and icons, and wherein at least one of the characters, numerals, symbols, barcodes, or icons in the image has a printed length different from that of at least one of the other characters, numerals, symbols, barcodes, or icons in the image.

31. The method of claim 22, wherein the image comprises one or more of characters, numerals, symbols, background patterns, barcodes, and icons, and wherein at least one of the characters, numerals, symbols, barcodes, or icons in the image has a printed length different from that of at least one of the other characters, numerals, symbols, barcodes, or icons in the image.

* * * * *